US009673563B2

(12) United States Patent
Kataoka

(10) Patent No.: US 9,673,563 B2
(45) Date of Patent: Jun. 6, 2017

(54) CONNECTOR

(71) Applicant: Sumitomo Wiring Systems, Ltd., Yokkaichi, Mie (JP)

(72) Inventor: Shigeto Kataoka, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/084,566

(22) Filed: Mar. 30, 2016

(65) Prior Publication Data

US 2016/0315416 A1 Oct. 27, 2016

(30) Foreign Application Priority Data

Apr. 21, 2015 (JP) ..... 2015-086818

(51) Int. Cl.
*H01R 13/52* (2006.01)
*H01R 13/502* (2006.01)

(52) U.S. Cl.
CPC ..... *H01R 13/5205* (2013.01); *H01R 13/502* (2013.01); *Y10S 439/901* (2013.01)

(58) Field of Classification Search
CPC ..... H01R 13/502; H01R 13/5205; H01R 13/5221; H01R 13/629; Y10S 439/901; Y10S 439/902
USPC ..... 439/271, 274, 275, 345, 901, 902
See application file for complete search history.

(56) References Cited

U.S. PATENT DOCUMENTS 6,132,250 A * 10/2000 Shinozaki ..... H01R 13/5216 439/587
6,443,766 B2 * 9/2002 Ichio ..... 439/274
6,485,332 B1 * 11/2002 Kwang ..... H01R 13/443 439/587
7,153,150 B2 * 12/2006 Atsumi ..... H01R 13/5216 439/204
7,922,503 B1 * 4/2011 Kobayashi ..... H01R 13/6295 439/157
8,113,880 B2 * 2/2012 Cappe ..... H01R 13/5205 439/274
8,568,159 B2 * 10/2013 Noda ..... H01R 13/562 439/470
8,608,508 B2 * 12/2013 Kataoka ..... H01R 13/5208 439/275
9,225,104 B2 * 12/2015 Suzuki ..... H01R 13/5208
9,306,319 B2 * 4/2016 Kataoka ..... H01R 13/506
(Continued)

FOREIGN PATENT DOCUMENTS

JP 2013-20774 1/2013

*Primary Examiner* — Tulsidas C Patel
*Assistant Examiner* — Travis Chambers
(74) *Attorney, Agent, or Firm* — Gerald E. Hespos; Michael J. Porco; Matthew T. Hespos

(57) ABSTRACT

A connector (10A) is provided with a housing (20) including a tube (22) and a seal (80) to be fit in the tube (22) in a liquid-tight manner. A holder (60) has a peripheral wall (62) fit externally on the tube (22) and a rear wall (61) configured to prevent the seal (80) from coming out backward. A wire cover (50) is mounted on the housing (20) by being fit externally on the peripheral wall (62) when the wire cover (50) is arranged to cover wires (100) pulled out from the holder (60) and the peripheral wall (62) is disposed in a proper posture on the tube (22). However, the wire cover (50) interferes with the holder (60) and cannot be mounted on the housing (20) when the peripheral wall (62) is in an improper posture inclined with respect to the tube (22).

6 Claims, 7 Drawing Sheets

(56) References Cited

U.S. PATENT DOCUMENTS

| | | | | |
|---|---|---|---|---|
| 9,306,320 | B2 * | 4/2016 | Kataoka | H01R 13/506 |
| 2011/0312198 | A1 * | 12/2011 | Komiyama | H01R 13/62977 439/157 |
| 2015/0056846 | A1 * | 2/2015 | Kataoka | H01R 13/506 439/456 |
| 2016/0064851 | A1 * | 3/2016 | Kataoka | H01R 13/5202 439/587 |

* cited by examiner

CONNECTOR

BACKGROUND

1. Field of the Invention

The invention relates to a connector.

2. Description of the Related Art

Japanese Unexamined Patent Publication No. 2013-20774 discloses a connector has a housing including a terminal accommodating portion with cavities into which terminal fittings are to be inserted and a tubular accommodating recess projecting back from the terminal accommodating portion. A one-piece rubber plug is fit into the tube in a liquid-tight manner and has seal holes into which wires connected to the terminal fittings are insertable in a liquid-tight manner. A holder is mounted on the housing to hold the rubber plug and is formed with through holes into which the wires are loosely insertable. A wire cover is mounted on the housing to cover the wires pulled out from the through holes. The wire cover is slid to be mounted on the housing after the rubber plug and the holder are assembled with the housing and the terminal fittings are inserted into the cavities.

The properly mounted holder prevents the rubber plug from coming out from the housing and ensures sealing by the rubber plug. However, the holder may be disposed in an improper inclined posture with respect to the housing and, the wire cover may be mounted on the housing with the holder misaligned. Thus, the improper posture of the holder may not be noticed since the holder is hidden behind the wire cover.

The invention was completed based on the above situation and aims to provide a connector capable of avoiding a situation where a holder is left in an improper posture.

SUMMARY

The invention is directed to a connector with a terminal fitting to be connected to a wire. The connector includes a housing with a main body formed with a cavity into which the terminal fitting is inserted from behind. A tube projects back from the housing main body, and a seal is fit into the tube in a liquid-tight manner. The seal has a seal hole at a position communicating with the cavity, and the wire is insertable into the seal hole in a liquid-tight manner. A holder includes a peripheral wall to be fit externally on the tube and a rear wall configured to prevent the seal from coming out backward. The rear wall is formed with a through hole at a position communicating with the seal hole, and the wire is loosely insertable into the through hole. A wire cover is mounted on the housing by being fit externally on the peripheral wall and covers the wire pulled out from the holder when the peripheral wall is disposed in a proper posture on the tube. However, the wire cover interferes with the holder to prevent mounting onto the housing when the peripheral wall in an improper posture inclined with respect to the tube.

The holder includes the peripheral wall that is fit externally on the tube of the housing. However, the wire cover interferes with the holder when peripheral wall is in an improper posture inclined with respect to the tube so that the wire cover cannot be mounted onto the housing. Thus, it can be detected that the holder is disposed in an improper posture when the mounting of the wire cover is prevented, and a situation where the holder is left in the improper posture can be avoided.

A cover lock may be provided on an outer surface of the tube, and a fitting groove may be provided on the peripheral wall for receiving the cover lock. The wire cover may include a housing lock to be locked by the cover lock. The peripheral wall may be mounted on the tube in an orientation opposite to the proper one. However, the cover lock cannot fit into the fitting groove of the peripheral wall in this situation. Thus, a situation where the holder is mounted erroneously can be prevented before the wire cover is mounted. Further, erroneous mounting of the holder is prevented by the cover lock so that the configuration is simplified as compared to the case where a dedicated erroneous mounting preventing structure is provided separately from the cover lock.

DETAILED DESCRIPTION

Figure 1:
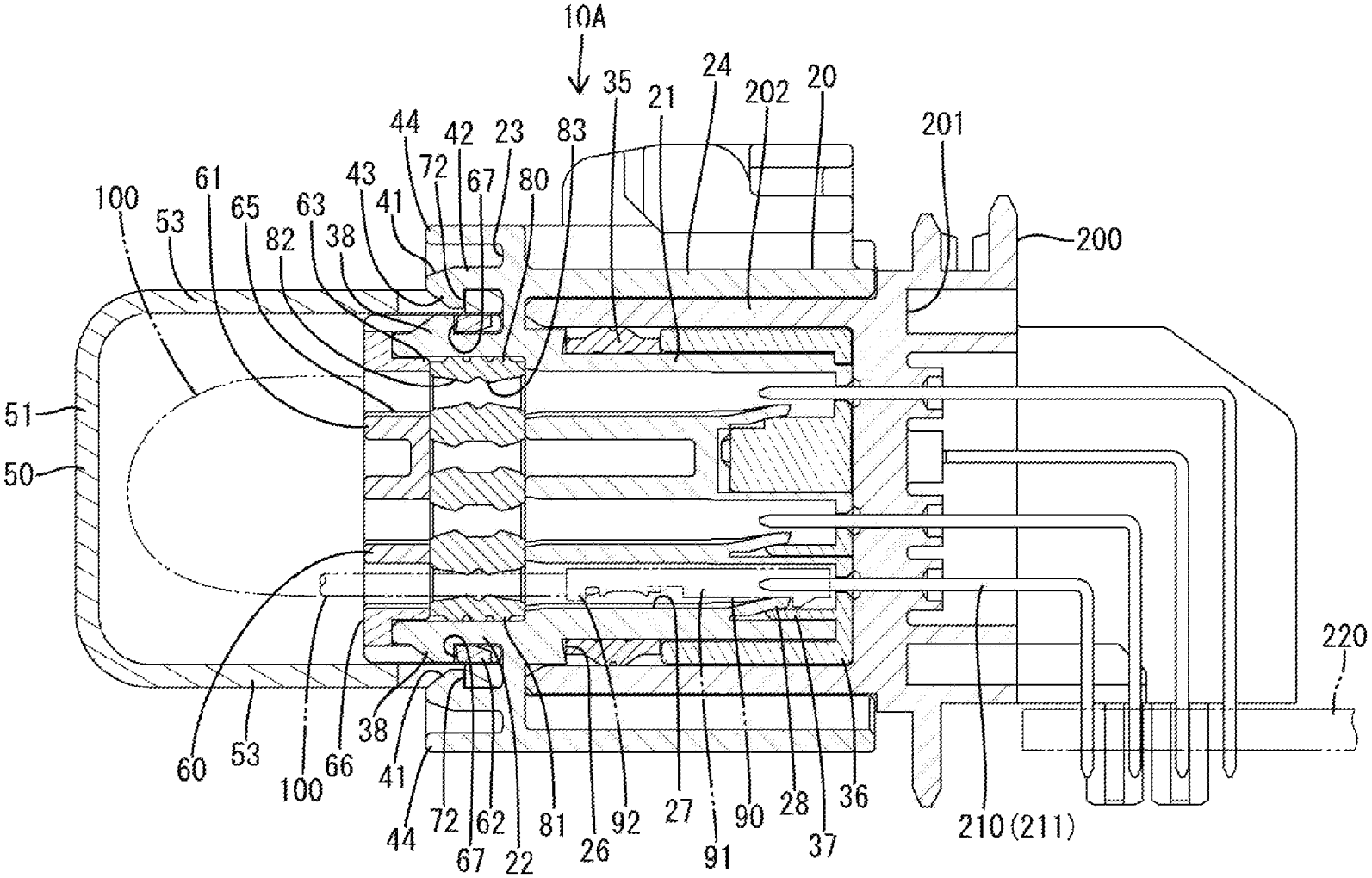
FIG. 1 is a side view in section showing a state where a housing is properly connected to a mating housing in a connector according to one embodiment of the present invention.

As shown in FIG. 1, a connector 10A, 10B of this embodiment includes terminal fittings 90 to be connected to end parts of wires 100 and a housing 20 capable of accommodating the terminal fittings 90. A seal 80 is accommodated in the housing 20, and a holder 60 is mounted on the housing 20 for retaining the seal 80. A wire cover 50 is mounted on the housing 20 following the holder 60. The housing 20 is connectable to a mating housing 200. Further, the housing 20, the holder 60 and the wire cover 50 collectively are called a connector main body 300. In the following description, surfaces that face each other when the connection of the two housings 20, 200 is started are referred to as front ends concerning a front-back direction. Additionally, a vertical direction is based on FIG. 1. Further, a width direction is synonymous with a lateral direction of FIGS. 2 to 7.

Figure 3:
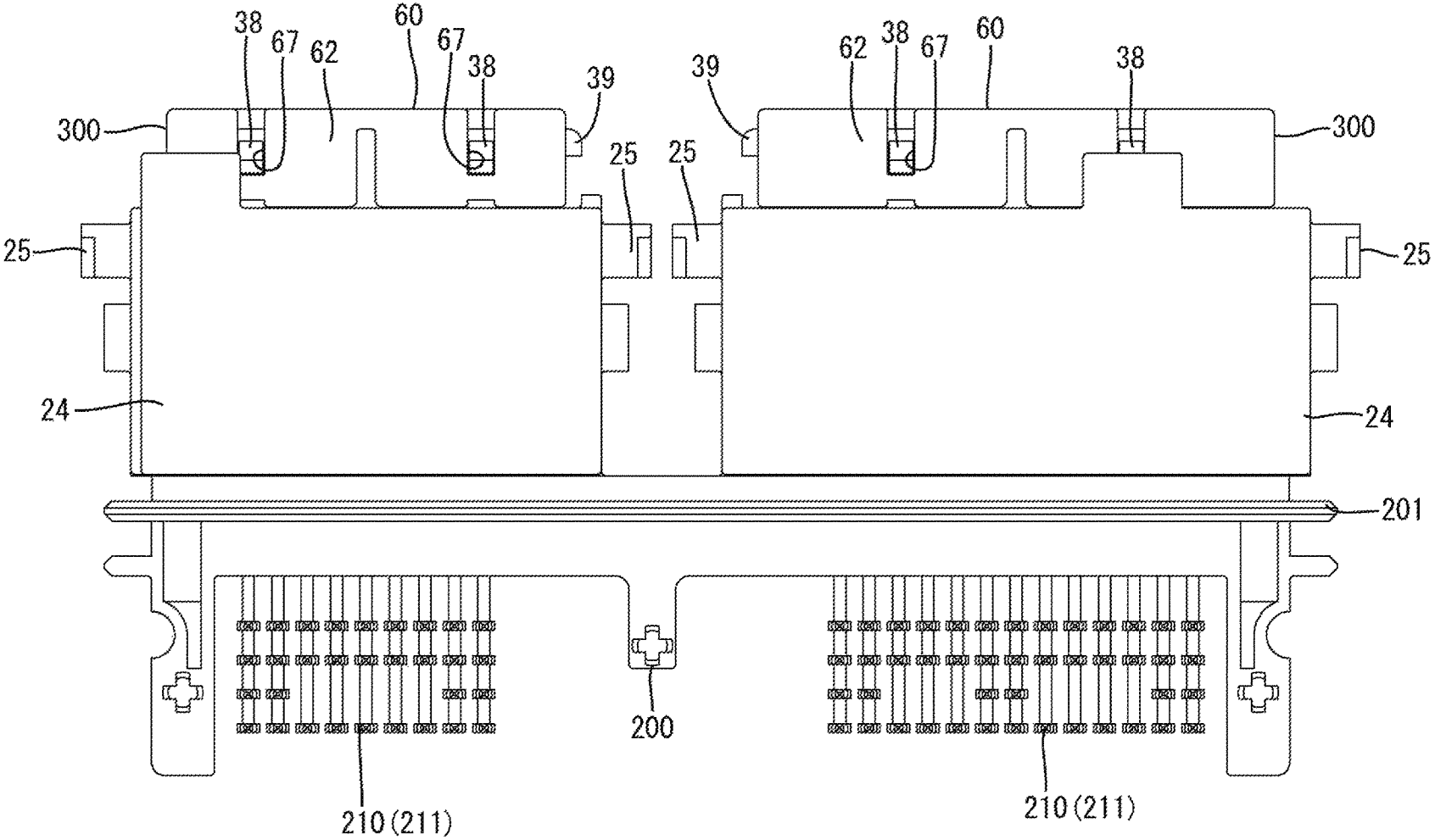
FIG. 3 is a bottom view showing a holder is fit externally on a tube of the housing.

The mating housing 200 is made of synthetic resin and includes a base wall 201 in the form of a flat plate extending along the width direction, as shown in FIG. 3. Two tubular receptacles 202 project forward from areas of the base wall 201 on opposite widthwise sides as shown in FIG. 1. Both receptacles 202 are configured to have different widths.

As shown in FIG. 1, male tabs 211 of mating terminal fittings 210 project into the receptacle 202. The male tabs 211 of the mating terminal fittings 210 project back of the receptacle 202 while penetrating through the base wall 201, and lower end parts bent down behind the receptacle 202 are inserted and connected to a printed circuit board 220.

The connectors 10A, 10B are provided to correspond individually to the receptacles 202 and have mutually different widths. Unless otherwise mentioned, the larger connector 10A is described below out of the larger and smaller connectors 10A, 10B having different widths. Further, regardless of a difference in size and the like between the connectors 10A, 10B, the same or corresponding parts are denoted by the same reference signs.

Figure 2:
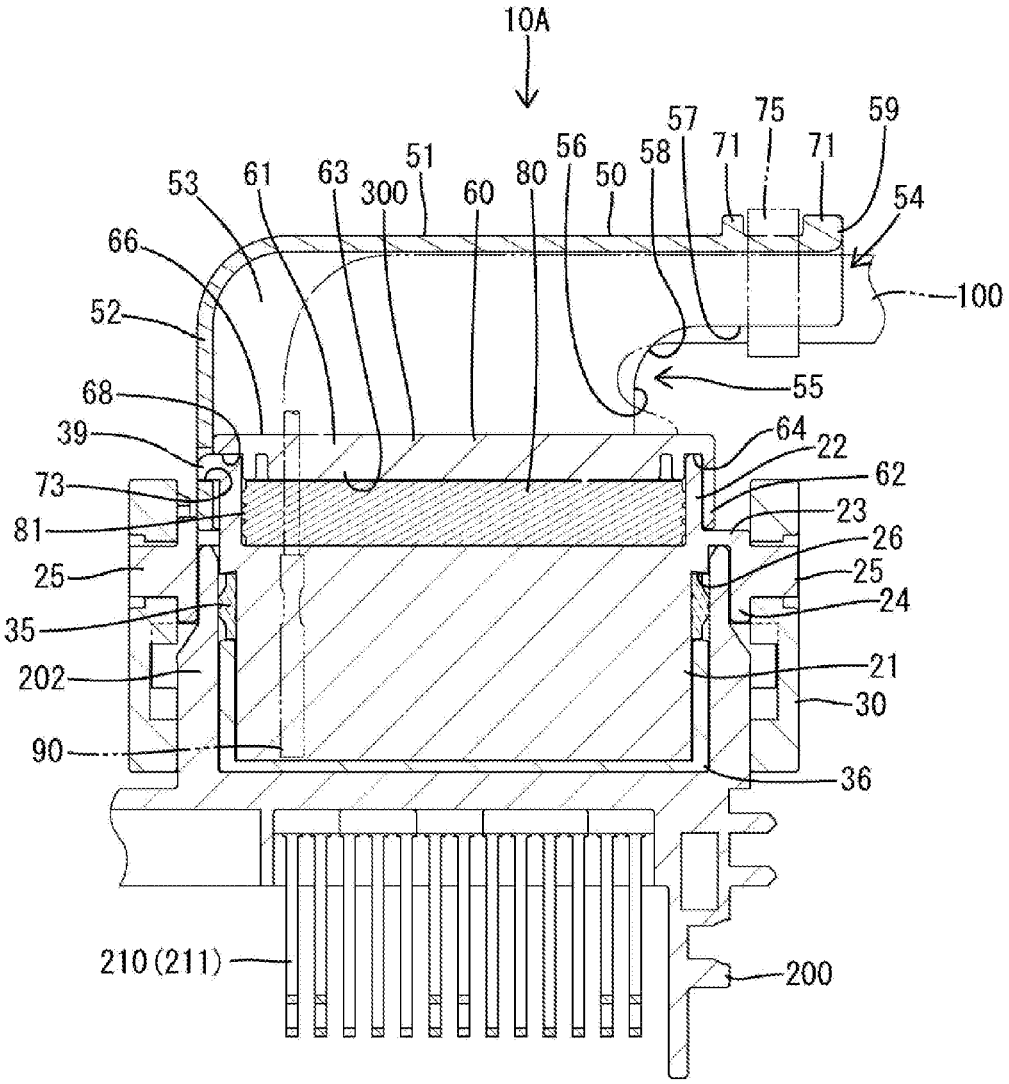
FIG. 2 is a bottom view in section of the housing properly connected to the mating housing.

The housing 20 is made of synthetic resin and includes, as shown in FIGS. 1 and 2, a main body 21 in the form of a substantially rectangular block. A tube 22 projects integrally back from the outer periphery of a rear end part of the main body 21. A coupling 23 integrally protrudes out from a part of the tube 22 continuous with the main body 21 and an outer tube 24 projects integrally forward from a protruding outer end part of the coupling 23 and surrounding the outer periphery of the main body 21. The receptacle 202 of the mating housing 200 can fit into a space between the main body 21 and the outer tube 24 and before the coupling 23.

As shown in FIGS. 2 and 3, two substantially cylindrical supporting shafts 25 project on outer surfaces of opposite widthwise ends of the outer tube 24. A lever 30 is mounted rotatably on the supporting shafts 25. As shown in FIG. 5, the lever 30 includes an operating portion 31 extending in the width direction and two arms 32 projecting in parallel with each other from opposite widthwise ends of the operating portion 31, and is mounted to straddle the housing 20 from above. By rotating the lever 30 while gripping the operating portion 31 in a state where the arms 32 are engaged with the receptacle 202 of the mating housing 200, the two housings 20, 200 are connected to each other. In this case, the lever 30 is rotated from an initial position (see FIGS. 4 to 7) where the operating portion 31 is arranged above the housing 20 to a connection position where the operating portion 31 is arranged behind the wire cover 50.

Further, as shown in FIGS. 1 and 2, a seal ring 35 is fit onto the outer surface of the housing main body 21 from the front. The seal ring 35 is sandwiched resiliently between the housing main body 21 and the receptacle 202 when the two housings 20, 200 are connected properly, thereby functioning to seal between the two housings 20, 200 in a liquid-tight manner. The seal ring 35 is sandwiched between a step 26 formed on the outer surface of the housing main body 21 and a front retainer 36 to be described later, thereby being arranged in a state substantially positioned in the front-back direction.

As shown in FIG. 1, the housing main body 21 is provided with a plurality of cavities 27 extending in the front-back direction at positions corresponding to the respective mating terminal fittings 210. A deflectable locking lance 28 is provided to project forward at an inner wall of each cavity 27. The terminal fitting 90 is inserted into each cavity 27 from behind and the properly inserted terminal fitting 90 is resiliently locked and retained by the locking lance 28.

Further, as shown in FIG. 1, the front retainer 36 is mounted onto the main body 21 from the front. By properly mounting the front retainer 36 on the main body 21, retaining protrusions 37 provided in the front retainer 36 are inserted into deflection spaces for the locking lances 28 to regulate the deflection of the locking lances 28. As a result, the terminal fittings 90 are locked doubly.

The terminal fitting 90 is formed integrally by applying bending and the like to an electrically conductive metal plate and includes, as shown in FIG. 1, a long narrow tubular connecting portion 91 and an open barrel 92 connected to and behind the connecting portion 91. The male tab 211 of the mating terminal fitting 210 is inserted and connected to the connecting portion 91 when the two housings 20, 200 are connected properly. Further, the barrel portion 92 is crimped and connected to a front end part of the wire 100.

The tube 22 is substantially rectangular and includes, as shown in FIG. 5, two long side walls 29 extending parallel to each other in the width direction, two short side walls 33 extending parallel to each other in a vertical direction and arcuate round corners 34 connecting the long side walls 29 and the short side walls 33 on four corners. The seal 80 is inserted and accommodated into the tube portion 22 from behind.

The seal 80 is made of rubber, such as silicon rubber, and is a mat sized to cover the rear surface of the main body 21 by being fit into the tube 22. As shown in FIG. 1, outer peripheral lips 81 are provided over the entire circumference one after another in the front-back direction on the outer peripheral surface of the seal 80. Circular seal holes 82 penetrate the seal 80 in the front-back direction at positions corresponding to and communicating with the respective cavities 27. Inner peripheral lips 83 are provided over the entire circumference of the inner surface of the seal hole 82 and are arranged one after another in the front-back direction. When the seal 80 is inserted properly into the tube 22, the outer peripheral lips 81 are held resiliently in close contact with the inner peripheral surface of the tube 22 and the interior of the tube 22 is sealed in a liquid-tight manner. Further, the wire 100 connected to the terminal fitting 90 is inserted into the seal hole 82 with the terminal fitting 90 properly inserted in the cavity 27 so that the inner peripheral lips 83 are held resiliently in close contact with the outer peripheral surface of the wire 100 and sealing is provided around the wire 100 in a liquid-tight manner.

As shown in FIG. 5, two holder locks 38 project in areas on opposite widthwise ends of the outer surface of each of the long side walls 29 of the tube 22. As shown in FIG. 1, the holder lock 38 is a claw and is lockable to a holder lock receiving portion 67 of the holder 60.

As shown in FIG. 5, a cover lock 39 projects on a rear end part of a substantially vertical center of the outer surface of the short side wall 33 that faces the smaller connector 10B of the tube 22. As shown in FIG. 2, the cover lock 39 is a claw and is lockable to a later-described housing lock 73 of the wire cover 50. Vertical and projecting dimensions of the cover lock 39 are larger than width and projecting dimensions of the holder lock 38.

As shown in FIG. 5, two resilient locks 41 project back at vertically spaced-apart positions of an area on one widthwise end side (area on a side distant from the smaller connector 10B) of the rear surface of the coupling 23. In the case of this connector 10A, the resilient locks 41 are arranged proximate to positions facing the holder locks 38. As shown in FIG. 1, the resilient lock 41 has a resiliently deflectable lock main body 42 extending back from the rear surface of the coupling 23 and a claw-like lock projection 43 projecting out (up or down) from an extending end of the lock main body 42. The lock projection 43 is lockable to a later-described resilient lock receiving portion 72 of the wire cover 50 after the resilient lock main body 42 is deflected.

Protection walls 44 stand at positions corresponding to the resilient locks 41 on the rear surface of the coupling 23 and cover the resilient locks 41 from the outside, as shown in FIG. 1. The protection wall 44 has a substantially angular U shape in a rear, as shown in FIG. 5, to surround areas of the resilient lock 41 excluding a surface facing the tube 22.

The holder 60 is made of synthetic resin and defines a cap, as shown in FIGS. 1 and 2, with a rear wall 61 capable of covering the rear surface of the seal 80 and a peripheral wall 62 projecting forward from the outer periphery of the rear wall 61 and externally fittable to the tube 22. The rear wall 61 includes a thick portion 63 that is thick in the front-back direction and insertable into the tube 22 of the housing 20. As shown in FIG. 2, an insertion groove 64 is provided over the entire circumference between the thick portion 63 and the peripheral wall 62 on the rear surface of the holder 60 and can receive a tip part of the tube 22.

Substantially circular through holes 65 penetrate the rear wall 61 of the holder 60 in the front-back direction at positions corresponding to and communicating with the respective seal holes 82, as shown in FIG. 1. The wire 100 extending from the seal hole 82 is inserted loosely into each through hole 65. The rear surface of the rear wall 61 (connector main body 300) is arranged substantially along the vertical direction and defines as a wire pull-out surface 66 through which the wires 100 are pulled out from the respective through holes 65.

Figure 6:
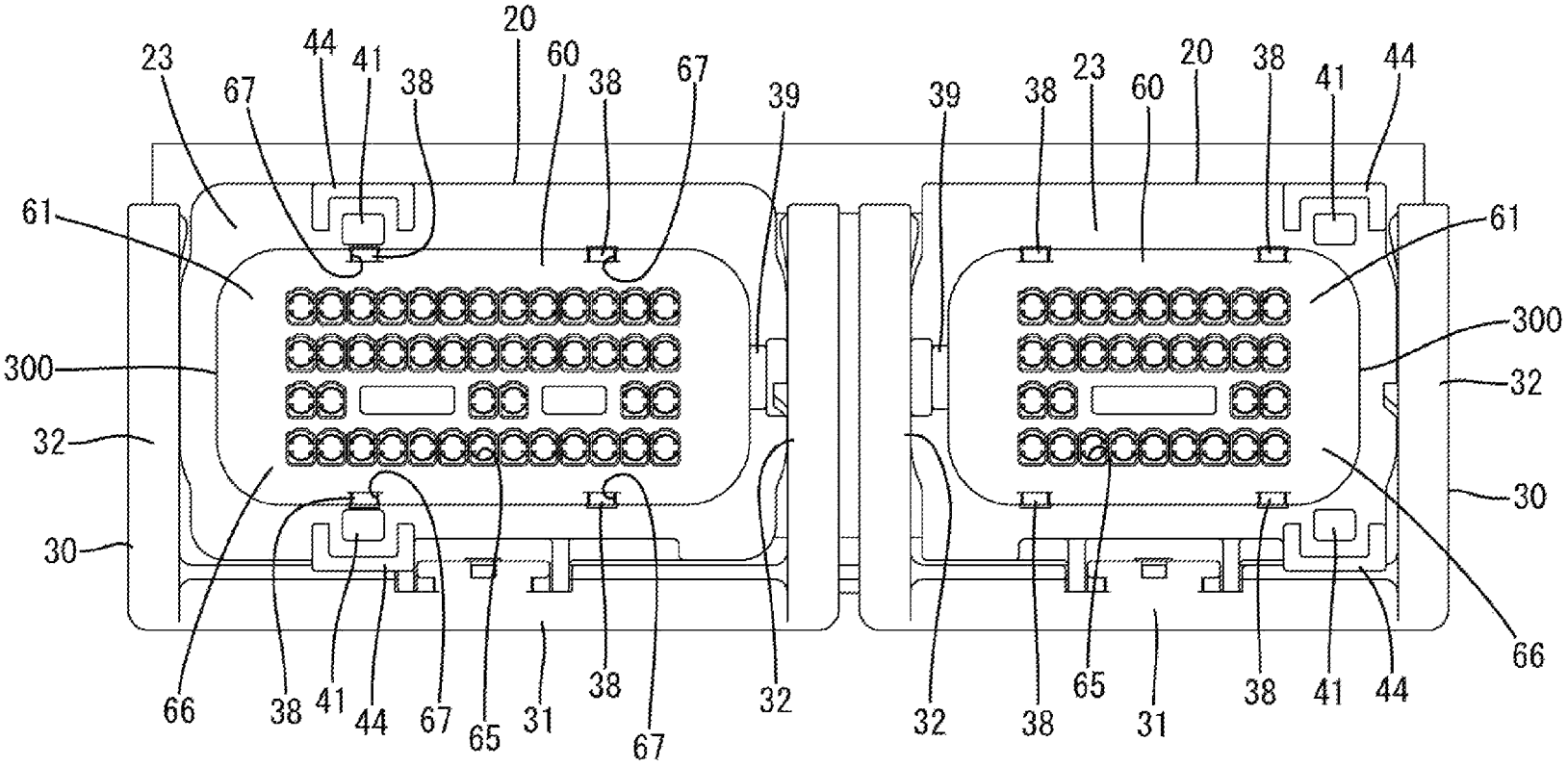
FIG. 6 is a rear view showing the holder fit externally on the tube of the housing.
Figure 7:
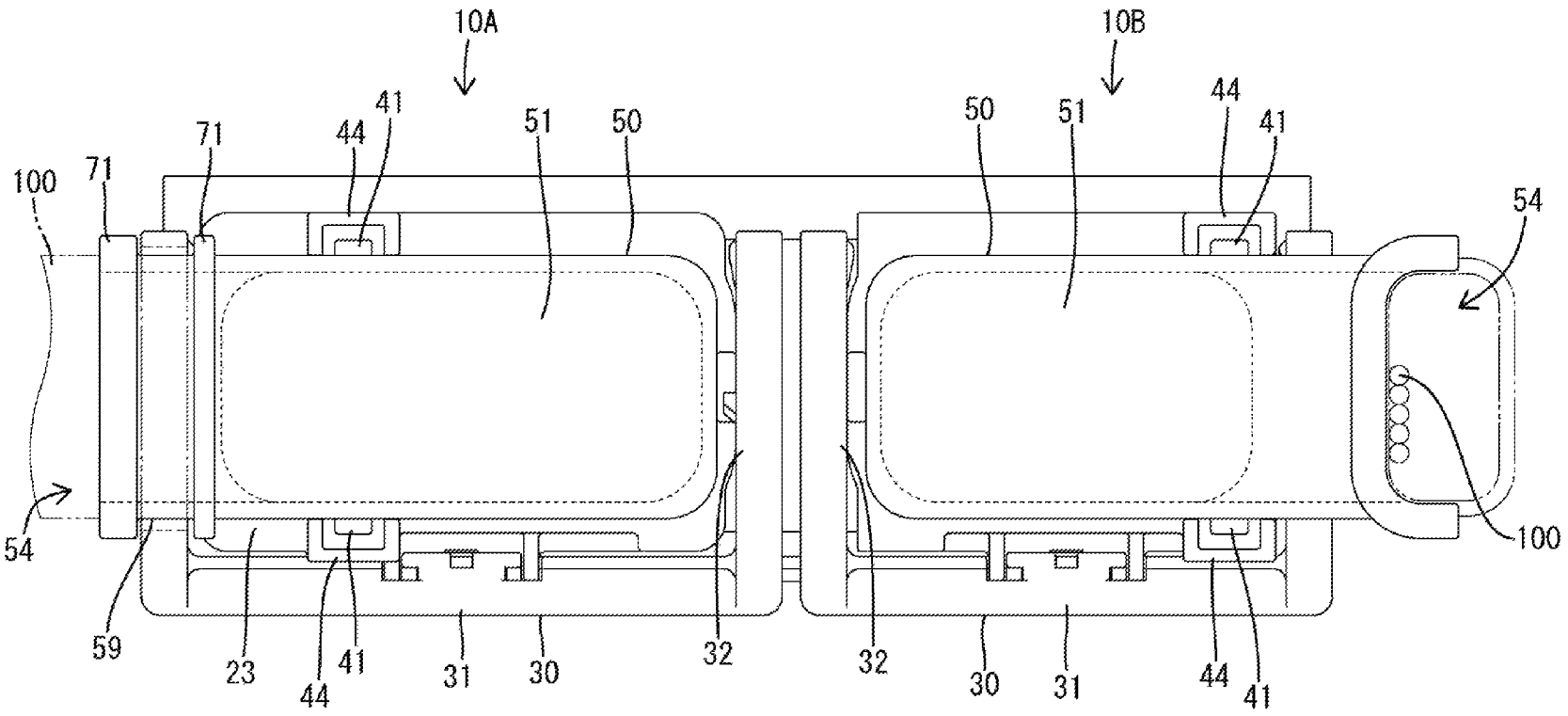
FIG. 7 is a rear view showing the wire cover mounted on the housing.

As shown in FIG. 6, holder lock receiving portions 67 penetrate the peripheral wall 62 of the holder 60 at positions corresponding to the respective holder locks 38 of the tube 22. As shown in FIG. 3, the holder lock receiving portion 67 extends in the front-back direction and is open on the rear surface of the rear wall 61. The holder 60 is retained and held on the housing 20 by resiliently fitting the holder locks 38 into the holder lock receiving portions 67 after the peripheral wall 62 is deflected. Further, by properly mounting the holder 60 on the housing 20 in this way, the seal 80 is held in the front-back direction between the thick portion 63 of the rear wall 61 and the housing main body 21, as shown in FIGS. 1 and 2. Furthermore, with the holder 60 properly mounted on the housing 20, the tip of the tube 22 is fit in the insertion groove 64 and the peripheral wall 62 is fit externally to the tube 22. The tip of the peripheral wall 62 is proximate to the coupling 23.

As shown in FIG. 2, the peripheral wall 62 of the holder 60 is cut substantially over the entire length in the front-back direction to provide a fitting groove 68 at a position corresponding to the cover lock 39. When the holder 60 is mounted properly on the housing 20, the cover lock 39 is fit into the fitting groove 68 so that a tip part thereof projects out toward one widthwise outer side from the fitting groove 68 (see FIG. 3).

The wire cover 50 is made of synthetic resin and defines a cap mounted on the housing 20 to cover the holder 60 from behind. As shown in FIG. 2, the wire cover 50 includes a back plate 51 arranged substantially to and at a distance from the wire pull-out surface 66 of the rear wall 61 (connector main body 300). A closing portion 52 extends forward from a part of the back plate 51 on the other widthwise end (end facing the smaller connector 10B) and two substantially parallel covering portions 53 (see FIG. 1) protrude from opposite edges of the closing portion 52 and the back plate 51. The widthwise side of the wire cover 50 opposite the closing portion 52 (side distant from the smaller connector 10B) is open as a draw-out opening 54 for the wires 100.

As shown in FIG. 2, each wire 100 is bent in the wire cover 50 and arranged along the back plate 51 after being pulled out from the wire pull-out surface 66, and drawn out to the one widthwise end from the draw-out opening 54. Note that, as shown in FIG. 4, in the case of the smaller connector 10B, a part of the back plate 51 on the one widthwise side (side distant from the larger connector 10A) projects back and each wire 100 is drawn out backward.

Figure 4:
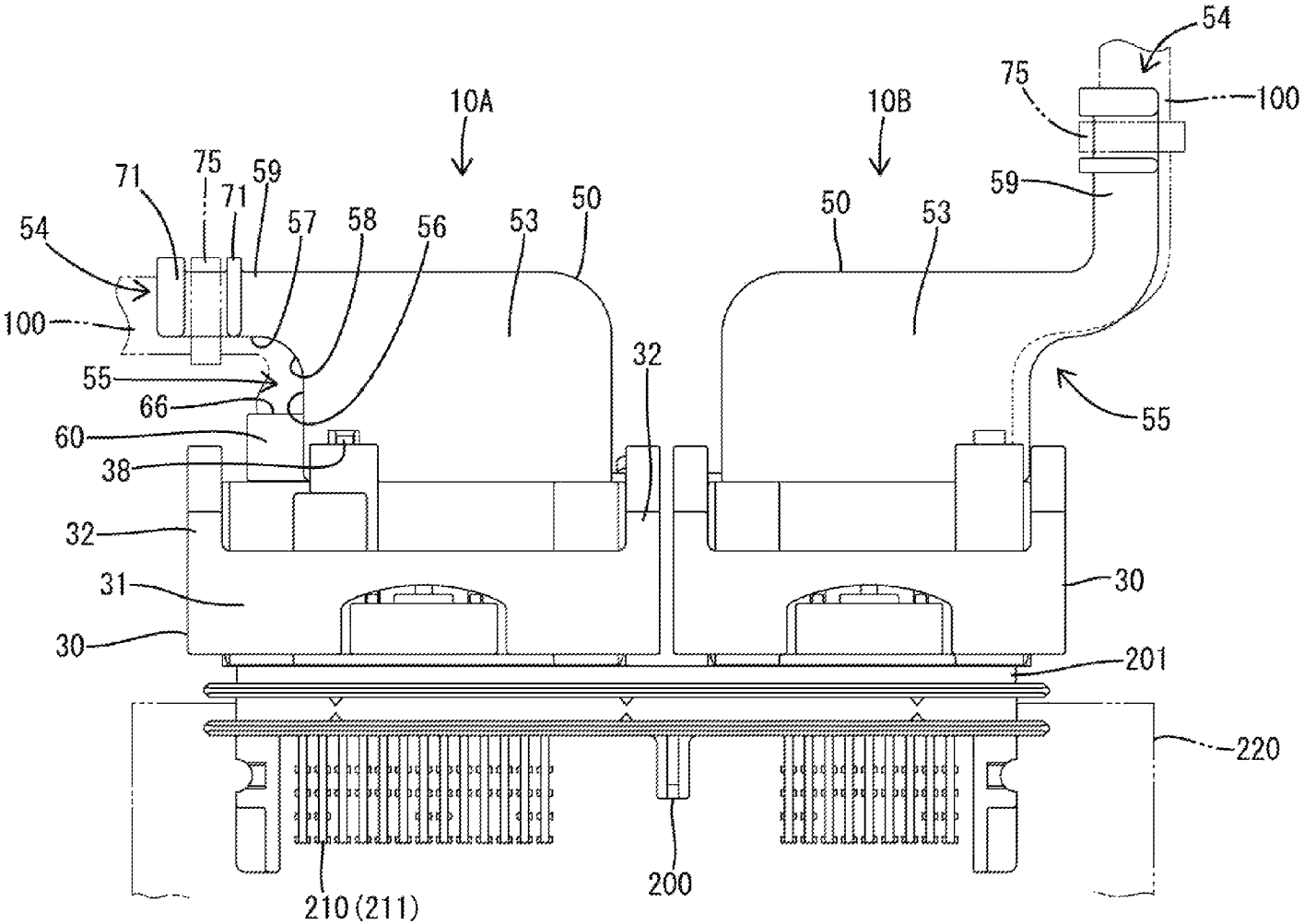
FIG. 4 is a top view showing a wire cover mounted on the housing.
Figure 5:
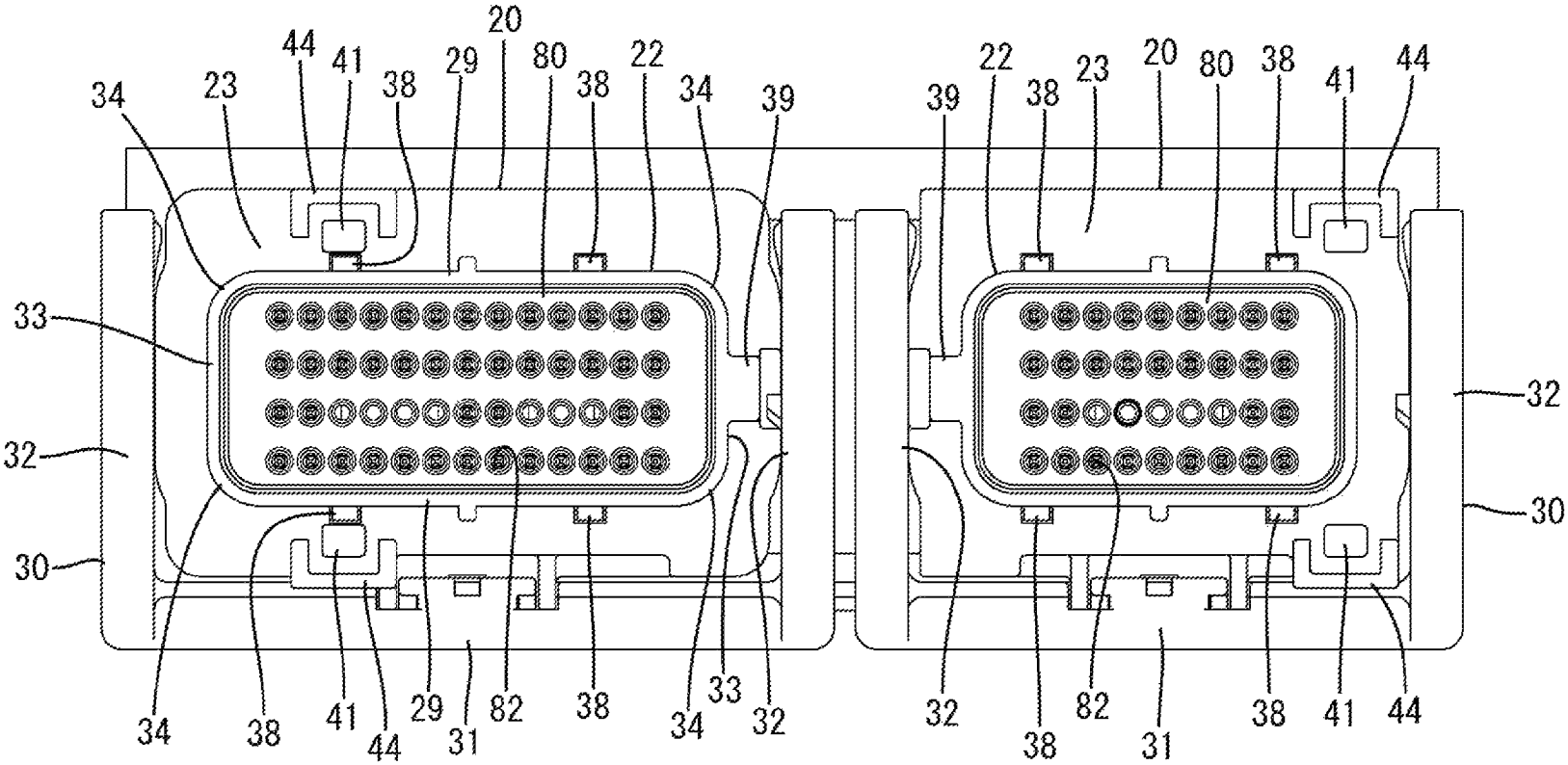
FIG. 5 is a rear view showing a seal member fit in the tube of the housing.

As shown in FIGS. 2 and 4, both covering portions 53 are cut along one widthwise edge from the front end so that an opening 55 is recessed. The opening 55 is defined by front-back edges 56 extending in the front-back direction and located at the front edges of the covering portions 53, lateral edges 57 extending in the width direction at the one widthwise ends of the covering portions 53 and arcuate edges 58 connecting the front-back edges 56 and the lateral edges 57.

Further, the wire cover 50 is provided with a mounting portion 59 having a substantially U-shaped cross-section and projecting toward the one widthwise end side in a part extending from the lateral edge portions 57 of the opening 55 to the back plate portion 51. A pair of ribs 71 are provided at a distance from each other in the front-back direction on the outer surface of the mounting portion 59. A binding band 75 such as a tie band for collectively binding the respective wires 100 is substantially positioned and mounted between the two ribs 71.

Two vertically spaced resilient lock receiving portions 72 are provided at positions of the covering portions 53 proximate to the opening 55, as shown in FIG. 1. The resilient lock receiving portion 72 is a rectangular hole and the lock projection 43 of the resilient lock 41 can fit therein. Further, as shown in FIG. 2, the closing portion 52 is provided with the housing lock 73. The housing lock 73 is a rectangular hole and the cover lock 39 can fit therein.

The wire cover 50 is held in a state where separation is regulated by the housing 20 by fitting the cover lock 39 to the housing lock 73 and fitting the lock projections 43 of the resilient locks 41 into the resilient lock receiving portions 72. With the wire cover 50 mounted on the housing 20, a front part of the wire cover 50 is fit externally on the peripheral wall 62 of the holder 60 and the covering portions 53 and the closing portion 52 are arranged along the outer surface of the peripheral wall 62, as shown in FIG. 1.

In the case of this connector 10A, as shown in FIGS. 2 and 4, the opening 55 is at a position overlapping with the wire pull-out surface 66 in the width direction, specifically the front-back edges 56 of the opening 55 are substantially transverse to the wire pull-out surface 66 when viewed in the vertical direction (facing direction of the covering portions 53) with the wire cover 50 mounted on the housing 20. Further, parts of the wires 100 pulled out from the area of the wire pull-out surface 66 on the one widthwise side and the area of the holder 60 on the one widthwise side are exposed and visually confirmable through the opening 55 when viewed in the vertical direction. On the other hand, as shown in FIG. 4, in the case of the smaller connector 10B, the wires 100 pulled out from the wire pull-out surface 66 are covered substantially entirely by both covering portions 53 when viewed in the vertical direction.

In assembling, the seal 80 is inserted into the tube 22 of the housing 20 from behind (see FIG. 5). When the seal 80 is fit properly into the tube 22, each outer peripheral lip 81 is held resiliently in close contact with the inner peripheral surface of the tube 22 and the seal holes 82 are arranged to communicate with the cavities 27 in the front-back direction.

Subsequently, the thick portion 63 of the rear wall 61 of the holder 60 is fit into the tube 22 of the housing 20 from behind and the peripheral wall 62 of the holder 60 is fit externally onto the tube 22 from behind. When the holder 60 is mounted properly on the housing 20, each holder lock 38 of the tube 22 is fit resiliently into each holder lock receiving portion 67 of the holder 60 to hold the holder 60 on the housing 20 in a state where separation is regulated (see FIG. 6). Further, the through holes 65 of the holder 60 communicate with the seal holes 82 in the front-back direction and the thick portion 63 contacts the rear surface of the seal 80, thereby preventing the seal 80 from coming out of the housing 20.

Further, in the process of mounting the holder 60, the cover lock portion 39 is inserted into the fitting groove 68 of the holder 60 to guide a mounting operation of the holder 60. On the other hand, if a mounting posture of the holder 60 is oriented to face in a direction different from the proper one with respect to the housing 20, such as by assuming a reverse posture in the width direction, the peripheral wall 62 of the holder 60 interferes with the cover lock 39 and the mounting of the holder 60 on the housing 20 is prevented. Thus, the cover lock 39 also functions as an erroneous mounting preventing portion for regulating erroneous mounting of the holder 60.

Subsequently, the terminal fittings 90 are inserted into the cavities 27 of the housing 20 from behind. In a state where the terminal fitting 90 is properly inserted in the cavity 27 and locked by the locking lance 28, each inner peripheral lip 83 is held resiliently in close contact with the outer peripheral surface of the wire 100, the wire 100 is inserted in the seal hole 82 of the seal 80 in a liquid-tight manner and the wire 100 is loosely inserted in the through hole 65 of the rear wall 61 of the holder 60 (see FIG. 1). Then, the wires 100 are pulled out backward from the wire pull-out surface 66 through the through holes 65 of the rear wall 61.

Further, the wire cover 50 is mounted onto the housing 20 from behind. In mounting, the cover lock 39 is inserted into the housing lock 73 and, in that state, the wire cover 50 is rotated from an opening position distant from the wire pull-out surface 66 to a closing position to approach the wire pull-out surface 66 with the cover lock 39 as a support. When the wire cover 50 mounted properly on the housing 20 in this way, both resilient lock receiving portions 72 are locked resiliently by the resilient locks 41 and the wire cover 50 is held on the housing 20. In this way, the wire cover 50 is locked to the housing 20 at three positions, i.e. at the housing lock 73 and both resilient lock receiving portions 72. Further, when the wire cover 50 is mounted on the housing 20, the covering portions 53 and the closing portion 52 of the wire cover 50 are fit externally on the peripheral wall 62 of the holder 60 (see FIGS. 1 and 2).

On the other hand, part of an incompletely mounted holder 60 is inclined with respect to the tube 22 of the housing 20, and a part of the holder 60 enters a mounting path for the wire cover 50 to prevent mounting the wire cover 50 on the housing 20. Thus, it can be known that the holder 60 is not mounted properly when the mounting of the wire cover 50 is prevented. In this case, the holder locks 38 of the tube 22 interfere with the inner surface of the tip of the peripheral wall 62 without being fit into the holder lock receiving portions 67 and the peripheral wall 62 is opened and deformed out so that the covering portions 53 of the wire cover 50 may interfere with the opened and deformed peripheral wall 62.

As the wire cover 50 is mounted on the housing 20, the respective wires 100 pulled out from the wire pull-out surface 66 are bent in the wire cover 50 and drawn out to the one widthwise side through the draw-out opening 54 (see FIG. 2). At this time, parts of the wires 100 are exposed and visually confirmable through the opening 55 of the wire cover 50.

Subsequently, fingers of an operator are inserted into the opening 55 of the wire cover 50 from outside on the one widthwise side and the respective wires 100 in the opening 55 are displaced toward the front-back edges 56 and bent to curve into a substantially U shape. The contact of the operator's fingers with a range of the opening 55 from the front-back edges 56 to the arcuate edges 58 compactly gathers the respective wires 100 on the side of the mounting portion 59 and arranges the wires 100 in the width direction along the mounting portion 59. Thereafter, by winding the binding band 75 between the ribs 71 of the mounting portion 59, the respective wires 100 are bound and held in the mounting portion 59 via the binding band 75.

As described above, the holder 60 includes the peripheral wall 62 to be fit externally on the tube 22 of the housing 20 and the wire cover 50 interferes with the holder 60 to regulate the mounting operation on the housing 20 if the holder 60 is mounted in an improper posture with the peripheral wall 62 inclined with respect to the tube 22. Thus, it can be known that the holder 60 is mounted in an improper posture when the mounting operation of the wire cover 50 is prevented, and a situation where the holder 60 is left in the improper posture can be avoided.

Further, if the peripheral wall 62 of the holder 60 is mounted on the tube 22 in a reverse orientation, the cover lock 39 cannot fit into the fitting groove 68 of the peripheral wall 62. Thus, a situation where the holder 60 is mounted erroneously in a reverse posture can be prevented before the wire cover 50 is mounted. Further, erroneous mounting of the holder 60 is prevented by the cover lock 39 for locking the wire cover 50. Thus, the configuration is simplified as compared to the case where a dedicated erroneous mounting preventing structure is provided separate from the cover lock 39.

The cover lock 39 has both a locking function of fixing the wire cover 50 to the housing 20 and an erroneous mounting preventing function for preventing erroneous mounting of the holder 60 on the housing 20. Thus, the structure is simplified and cost is reduced as compared to the case where the locking function and the erroneous mounting preventing function are separate parts.

The cover lock 39 is part of the tube 22 for accommodating the seal 80. Thus, it is not necessary to provide a special part for the cover lock 39 and the structure can be simplified.

Further, the holder 60 is recessed to form the fitting groove 68 and the cover lock 39 is fit into the fitting groove 68 to correct the inclination of the holder 60. Thus, the inclination of the holder 60 can be corrected utilizing the cover lock 39 and the structure is simplified.

Further, the operator's fingers are inserted into the opening 55 at the time of mounting the wire cover 50 and, in that state, the parts of the wires 100 exposed in the opening 55 are pressed and displaced toward the mounting portion 59 so that the wires 100 can be collected easily. Thus, an operation of mounting the binding band 75 on the mounting portion 59 can be performed smoothly thereafter. Further, since fingers can be pressed against the arcuate edges 58 of the opening 55 without any problem in collecting the respective wires 100, the operation can proceed smoothly.

Other embodiments are briefly described below.

The wire pull-out surface may be configured by the rear surface of the housing main body if no seal is required.

The operation of binding the respective wires and mounting them in the mounting portion may be performed by inserting a jig into the opening.

The mating housing may include only one receptacle corresponding to the housing of the connector described in the above embodiment (larger connector).

LIST OF REFERENCE SIGNS

10A, 10B . . . connector
20 . . . housing
21 . . . housing main body

22 . . . tube portion
27 . . . cavity
39 . . . cover lock portion (erroneous mounting preventing portion)
50 . . . wire cover
51 . . . back plate portion
53 . . . covering portion
55 . . . opening
58 . . . arcuate edge portion (part extending in a curved manner)
59 . . . mounting portion
60 . . . holder
61 . . . rear wall
62 . . . peripheral wall
65 . . . through hole
66 . . . wire pull-out surface
68 . . . fitting groove
73 . . . housing lock
75 . . . binding band (fixing means)
80 . . . seal member
82 . . . seal hole
90 . . . terminal fitting
100 . . . wire
200 . . . mating housing
300 . . . connector main body

What is claimed is:

1. A connector, comprising:

a terminal fitting to be connected to a wire;

a housing including a housing main body with opposite front and rear ends and formed with a cavity into which the terminal fitting is inserted from behind, and a tube projecting back from the housing main body, holder locks projecting out from the tube;

a seal fit into the tube in a liquid-tight manner and formed with a seal hole into which the wire is insertable in a liquid-tight manner at a position communicating with the cavity;

a holder including a rear wall configured to prevent the seal from coming out backward and formed with a through hole into which the wire is loosely inserted at a position of the rear wall communicating with the seal hole, a deflectable peripheral wall outward of the rear wall and being deflected out by the holder locks of the housing as the holder is being mounted on the housing, the peripheral wall including lock receiving portions that align with the holder locks when the holder is mounted properly on the housing thereby permitting the deflected peripheral wall to return to an undeflected posture and into engagement with the holder locks; and a wire cover mounted on the housing by being fit externally on the peripheral wall of the holder and covering the wire extending from the holder when the holder has been mounted properly on the housing so that the peripheral wall of the holder has returned to an undeflected posture, and the peripheral wall of the holder interfering with the wire cover to prevent mounting of the wire cover onto the housing when the peripheral wall of the holder remains deflected out with respect to the tube due to improper mounting of the holder on the housing.

2. The connector of claim 1, wherein a cover lock is provided on an outer surface of the tube, a fitting groove is provided on the holder for receiving the cover lock and the wire cover includes a housing lock to be locked by the cover lock.

3. The connector of claim 1, wherein the housing has resilient locks projecting back on the housing at positions outward from the tube, the wire cover having lock receiving portions that engage the resilient locks when the holder and the wire cover are mounted properly.

4. The connector of claim 3, wherein the housing further comprises a coupling projecting out from the tube at a position substantially between the tube and the housing main body, the resilient locks projecting back from the coupling.

5. The connector of claim 3, wherein the lock receiving portions are formed in covering portions of the wire cover, the covering portions being fittable between the peripheral wall and the resilient locks when the peripheral wall of the properly mounted holder has returned resiliently into engagement with the holder locks so that the lock receiving portions can engage the resilient locks, the covering portions being incapable of fitting between the peripheral wall and the resilient locks when the peripheral wall remains outwardly deflected due to improper mounting of the holder on the tube.

6. The connector of claim 5, wherein the cover lock is in proximity to a first longitudinal end of the housing, and wherein the holder locks and the resilient locks are in proximity to a second longitudinal end of the housing.

* * * * *